US005205611A

United States Patent [19]

Stephens

[11] Patent Number: 5,205,611

[45] Date of Patent: Apr. 27, 1993

[54] HEAD SUPPORT PILLOW

[75] Inventor: Frederick O. Stephens, 16 Inkerman Street, Mosman, Australia, 2088

[73] Assignees: Frederick Oscar Stephens; Sheilagh Kelly; Jennifer Louise Azzopardi; Robert Bruce Henry Stephens; Gillian Dorys Janet Stephens; Katriona Alison Stephens; Frederick William Peter Stephens, all of Mosman, Australia

[21] Appl. No.: 807,831

[22] PCT Filed: May 21, 1991

[86] PCT No.: PCT/AU91/00219

§ 371 Date: Feb. 18, 1992

§ 102(e) Date: Feb. 18, 1992

[87] PCT Pub. No.: WO91/17685

PCT Pub. Date: Nov. 28, 1991

[30] Foreign Application Priority Data

May 22, 1990 [AU] Australia ..... PK0266

[51] Int. Cl.[5] ..... A47G 9/00

[52] U.S. Cl. ..... 297/391; 5/636; 5/640; 5/922

[58] Field of Search ..... 5/636, 640, 643, 922, 5/490; 297/397, 391, 394; D6/502

[56] References Cited

U.S. PATENT DOCUMENTS

| | | | |
|---|---|---|---|
| 2,336,707 | 12/1943 | Thompson . | |
| 2,589,013 | 3/1952 | Martin | 297/391 |
| 2,765,480 | 10/1956 | Mueller | 5/640 |
| 2,953,793 | 9/1960 | Rossi | 5/465 |
| 2,983,310 | 5/1961 | Warlick et al. | 297/399 |
| 3,578,383 | 5/1971 | Earl | 5/636 |
| 3,608,964 | 9/1971 | Earl | 5/636 |
| 3,694,831 | 10/1972 | Treace | 5/636 |
| 4,285,081 | 8/1981 | Price | 5/637 |
| 4,440,443 | 4/1984 | Nordskog | 297/397 |

FOREIGN PATENT DOCUMENTS

| | | | |
|---|---|---|---|
| 2742356 | 3/1979 | Fed. Rep. of Germany . | |
| 2856366 | 2/1980 | Fed. Rep. of Germany | 297/397 |
| 1413309 | 8/1965 | France | 5/636 |
| 258350 | 9/1926 | United Kingdom | 297/397 |
| 2208793 | 4/1989 | United Kingdom . | |
| 2224435 | 5/1990 | United Kingdom . | |

*Primary Examiner*—Alexander Grosz
*Attorney, Agent, or Firm*—Jacobson, Price, Holman & Stern

[57] ABSTRACT

A pillow has a base portion against which the user rests his/her head and a lateral support portion which supports the user's head to resist rotation thereof about the axis of the user's neck. The pillow may also have a recess formed in the support portion for partially accommodating the user's head and thereby resisting relative movement between the pillow and the user's head. Further, the support portion may have a sufficient length so that, in use, it rests on a shoulder of the user to provide further stability to the pillow. A removable cover may be provided, and the pillow is preferably constructed from an expanded foam rubber or synthetic plastics material. In a second preferred embodiment the pillow is provided with two spaced lateral support potions on opposite sides of the base portion. The pillow may be rolled or folded into a compressed condition with the aid of cooperating hook and loop type fastener.

8 Claims, 3 Drawing Sheets

HEAD SUPPORT PILLOW

FIELD OF THE INVENTION

The present invention relates to a cushion, pillow or like article and, more particularly, to a such an article adapted to provide lateral support for a user's head when it is resting against an upwardly sloping surface such as the back of a seat.

BACKGROUND ART

Travellers, in particular, are often forced to sleep in a sitting position. This can occur during extended travel in aeroplanes, buses, cars, trains and the like. Various proposals have been made to provide supporting pillows to reduce the discomfort experienced by persons sleeping in a sitting position. These prior art pillows have included bone shaped pillows for insertion under the neck and inflatable pillows in the form of a collar extending about a user's neck. None of these pillows, however, provide adequate lateral support for the head of the user. The present invention is directed to a novel pillow adapted for use by travellers and others seeking to sleep with the head upwardly inclined.

DISCLOSURE OF THE INVENTION

The present invention consists in a cushion or pillow for laterally supporting a user's head when the user leans against an upright or upwardly inclined surface of a seat back or the like, comprising:

a base portion being generally thin and substantially planar and having an upper surface;

a lateral support portion being relatively thick, positioned laterally adjacent the base portion and projecting a predetermined distance transversely and upwardly from said upper surface; said base portion and lateral support portion also defining a generally continuous lower surface of the pillow;

whereby, in use, the pillow is positioned between the user's head and the inclined surface with the user's head bearing against the upper surface and leaning against the lateral support portion for supporting same against rotation about the axis of the user's neck.

The pillow according to the present invention enables the user to have his or her head comfortably supported lying back against the seat and inclined laterally slightly against the head support portion of the pillow. If desired the pillow may be provided with engagement means, such as strips of a hook and loop fastener, to assist in holding the major lower surface of the pillow in frictional engagement with the sloping surface. These engagement means may also be used to hold the pillow in a rolled-up or otherwise compressed form for transport or storage.

The pillow is preferably formed of a resilient foamed plastic or rubber material, however, it could be formed as an inflatable pillow. If desired the pillow may be covered by a removable cover of a woven or non-woven fabric. In the latter case the engagement means referred to in the last paragraph will be positioned on the cover.

The pillow according to the present invention is preferably of sufficient length that in use the lower end of the head support portion will rest on a user's shoulder. This assists in retaining the pillow in place under the user's head.

BRIEF DESCRIPTION OF THE DRAWINGS

Hereinafter given by way of example only is a preferred embodiment of the present invention described with reference to the accompanying drawings, in which.

DETAILED DESCRIPTION OF THE PREFERRED EMBODIMENT

Figure 1:
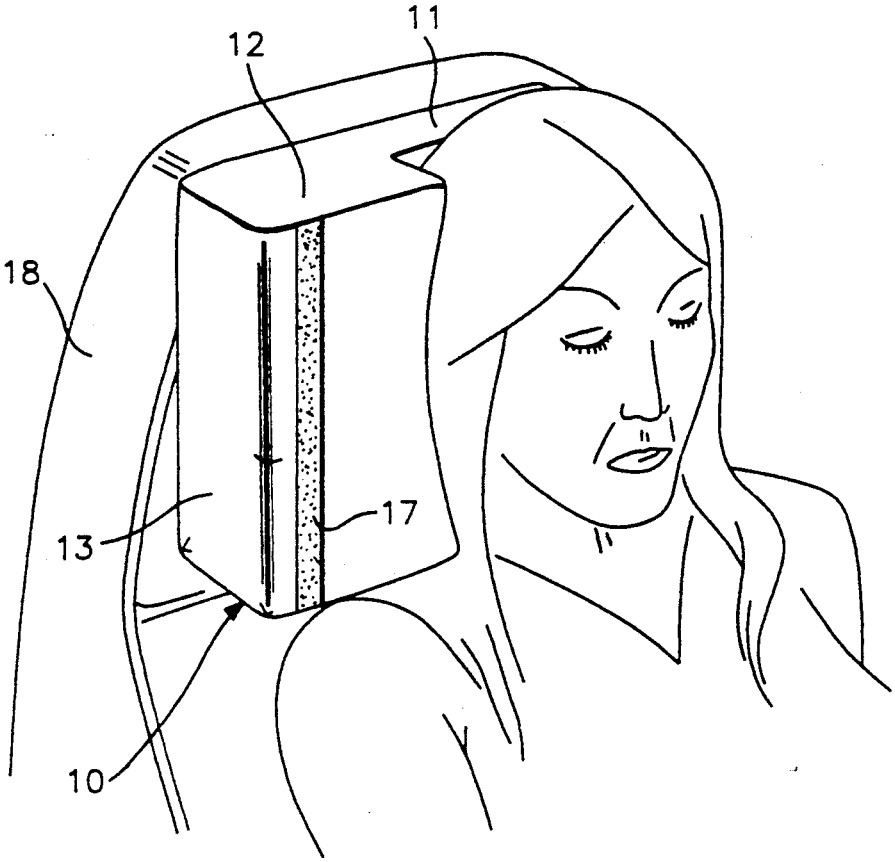
FIG. 1 is a perspective view of a pillow according to the present invention in use.

The pillow 10 comprises a block of a resilient foam rubber having a base portion 11 and a head support portion 12. The foam rubber block is encased in a removable fabric cover 13.

It is desirable that the pillow 10 provide adequate support to the user while not being too hard or uncomfortable. Accordingly, it is preferable that the foam rubber have a density/hardness ratio index number of between HR (high resilience) 22/40 and HR 32/80, and most preferably approximately HR30/60. Alternatively, the pillow may be constructed with a relatively rigid inside or lower portion and a relatively soft outside or upper layer.

Further, the foam rubber block may be constructed from two or more suitably shaped pieces, or a single integral piece, of foam rubber. For example, a first piece may define the base portion and a second piece may define the support portion with the two pieces abutting and being adhered to one another.

The base portion 11 comprises a rectangular prism of relatively small thickness. The head support portion 12 is also a rectangular prism and is formed integrally with the base portion 11, abutting it along one of its side edges. The head support portion 12 is of relatively great thickness, the difference in thickness between the two portions being sufficient that in use the head support portion will provide adequate lateral support to a user's head. Typically the thickness of the base portion 11 will be from 5 to 25 mm while that of the head support portion 12 will be from 50 to 150 mm.

Figure 2:
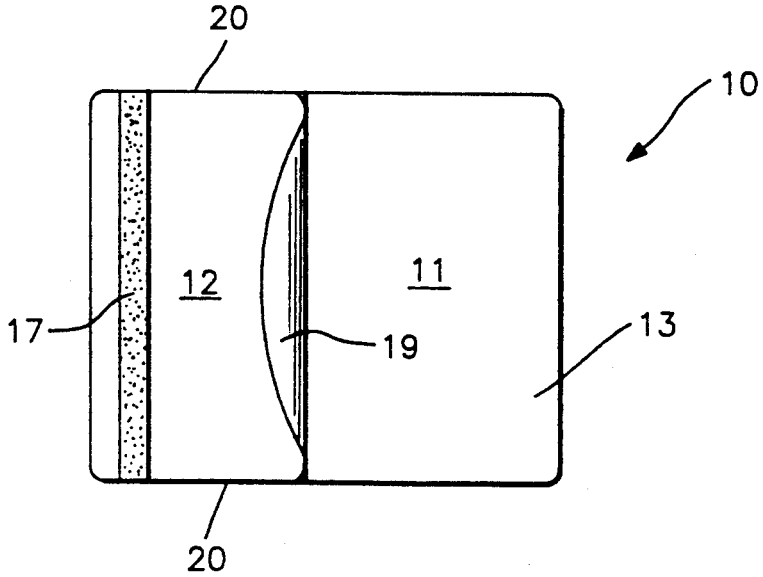
FIG. 2 is a front elevational view of the pillow of FIG. 1.
Figure 3:
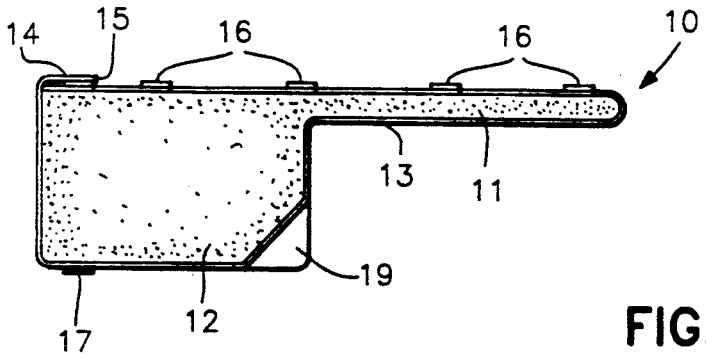
FIG. 3 is a horizontal sectional view through the pillow of FIG. 1.
Figure 4:
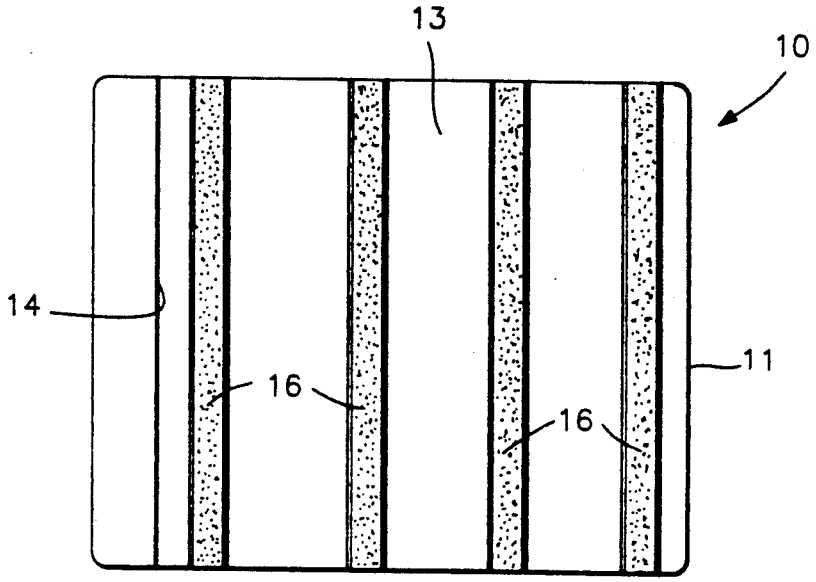
FIG. 4 is a rear elevational view of the pillow of FIG. 1.
Figure 5:
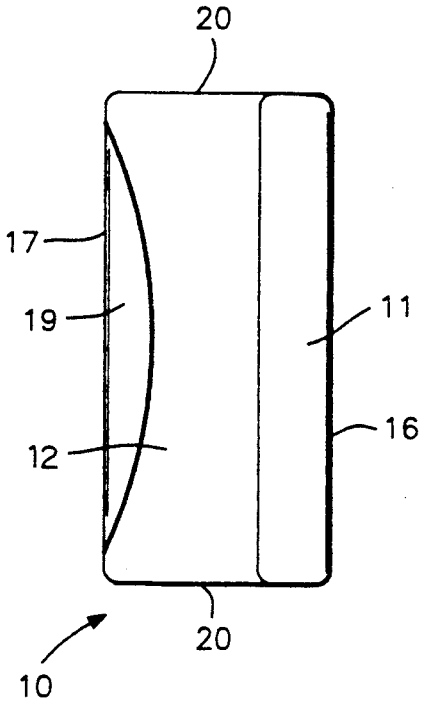
FIG. 5 is a side elevational view of the pillow of FIG. 1 seen from the user's left hand side.

The head support portion 12 further comprises a retaining means in the form of a beveled edge 19 against which, in use, the user's head leans. The beveled edge 19 has a maximum width of approximately 6 cm in a central portion of the elongate support portion 12, and which reduces towards each of the top and bottom ends 20 of the support portion 12 (see FIGS. 2 and 5). In use, when the user's head is leaning against the edge 19, the form of the beveled edge 19 partially accommodates the user's head so as to generally resist the pillow 10 from slipping downwards relative to the user's head.

The cover 13 is sized to closely surround the foam rubber block and is provided with an aperture 14 through which the foam rubber block may be removed if the cover is to be washed. This aperture 14 is bounded by a fastening mechanism such as complementary strips of a hook and loop fastening material 15 such as that sold under the Registered Trade Mark "VELCRO". The cover 13 may also be provided on its rear surface with a number of vertically extending strips 16 of the hook portions of a hook and loop fastener. The front face of the head support portion 12 is provided with a single strip 17 of the loop portion of a hook and loop fastener.

The fabric cover 13 could be a non-disposable woven cloth fabric or the like, or any other suitable fabric or material. The non-disposable fabric cover is washable or otherwise cleanable. Alternatively, the cover 13 may be of a spun bonded polypropylene material (such as a Kimberly Clark product sold under the "EVOLUTION" trade mark) being approximately 60 g/m$^2$ and which is slightly porous, and which is disposable.

In use the rear surfaces of the base 11 and of the head support portion 12 of the pillow 10 are placed against a suitable sloping surface, such as the back of seat 18, on which the user's head is to be rested. The pillow 10 is so placed that the user's head rests against the front or upper surface of the base portion 11 to retain the pillow 10 in place on the seat 18. The thicker head support portion 12 provides an additional retaining means in that the bottom edge rests on the user's shoulder so helping to keep the pillow in position. The strips, if attached, 16 also aid in retaining the pillow 10 in place by frictionally engaging the surface of the seat 18. The user's head can then pivot slightly about the neck such that it rests comfortably against, and is laterally supported by, the head support portion 12. Since the user's head is partially accommodated in the beveled edge 19, this further stabilises the pillow with respect thereto.

It will be appreciated that the pillow 10 should have overall dimensions which are adequate to allow the user's head to rest against the base portion whilst leaning against the support portion and, as mentioned above, for the pillow to extend down and to rest on the shoulder of the user. In this regard, the pillow is preferably approximately 31 cm wide (including the width of the support portion which is approximately 12 cm) and approximately 22 cm long.

Figure 6:
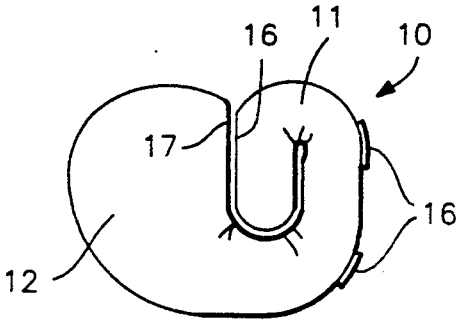
FIG. 6 is an end elevational view of the pillow of FIG. 1 rolled up for transport or storage.

When the pillow is to be stored or transported it can be rolled up into a compressed roll and the loop strip 17 engaged with one of the hook strips 16 to retain the pillow 10 in its compressed state (refer FIG. 6).

Figure 7:
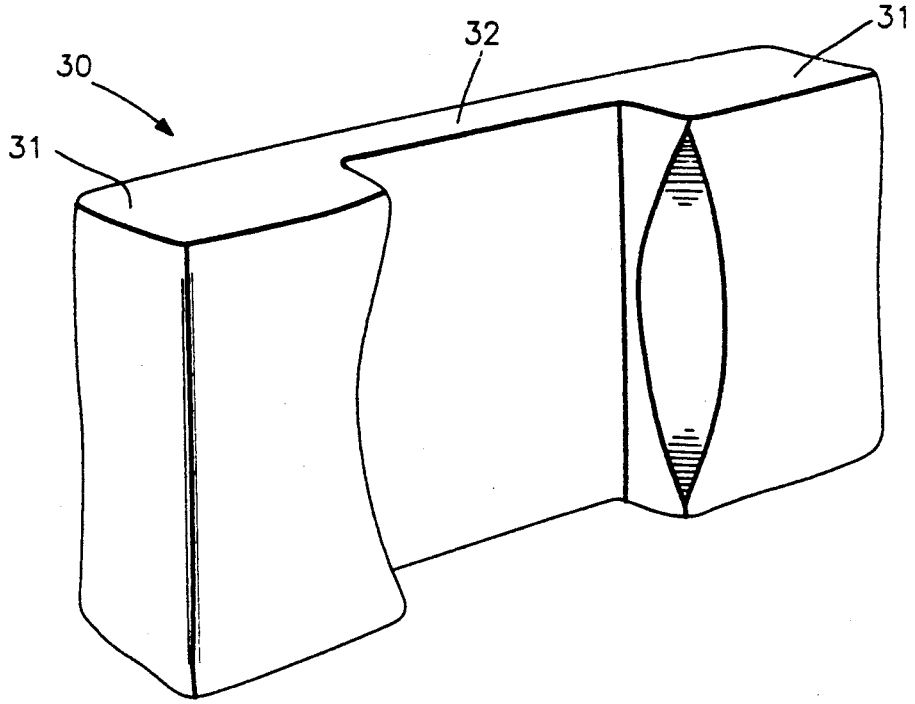
FIG. 7 is a perspective view of a second embodiment pillow according to the invention.
Figure 8:
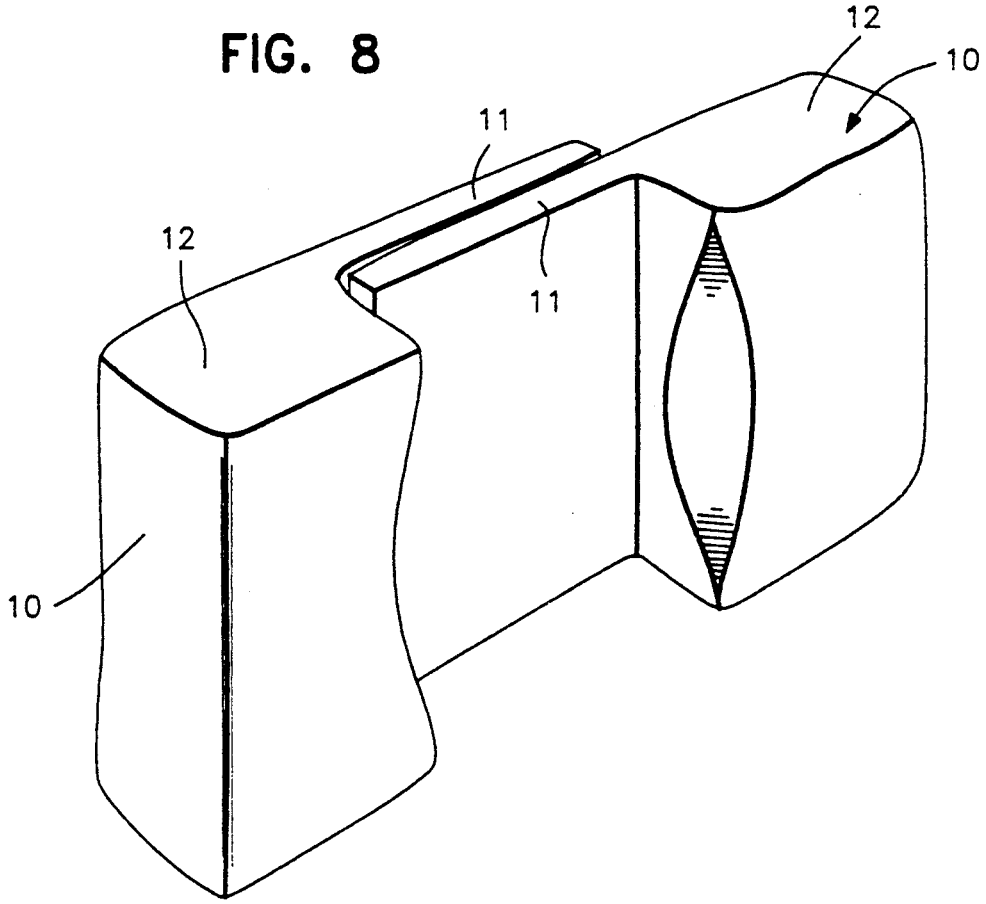
FIG. 8 is a perspective view of a modified form of the pillow shown in FIG. 7.

In a second embodiment of the present invention shown in FIG. 7, the pillow 30 has two spaced lateral support portions 31 on opposite sides of the base portion 32. Each support portion 31 is generally identical with the support portion 12 described above. The configuration of this embodiment may alternatively be produced by using two pillows 10 and overlapping the base portions 11 thereof as shown in FIG. 8. In order to retain the two pillows 10 in this relative position, strips of hook and loop fastening material may be attached to the upper side of one cushion 10 and the underside of the other cushion 10.

It will be recognised by persons skilled in the art that numerous variations and modifications may be made to the invention as described above without departing from the spirit or scope of the invention as broadly described.

I claim:

1. A travelling cushion formed of a resiliently compressible foam material and having a base portion which is generally thin and substantially planar and a lateral head support portion formed integrally with the base portion, the head support portion being relatively thick and projecting laterally of and upwardly from an upper surface of the base portion, the base portion and the lateral head support portion defining a generally continuous and substantially planar lower surface of the travelling cushion, the construction of the travelling cushion being such that it may be positioned between a user's head and an upwardly inclined supporting surface with the user's head bearing against the upper surface of the base portion and leaning against the lateral support portion which supports the user's head against rotation about the axis of the user's neck, with the head support portion being of sufficient length such that, in use, a bottom edge thereof rests on the shoulder of the user, the travelling cushion being enclosed within a unitary removable cover and being such that it may be rolled or folded into a compressed condition, the travelling cushion being provided with securing means for retaining the cushion in a compressed condition said securing means comprising a pair of complimentary portions of hook and loop fastener means, whereby when the cushion is in a compressed condition the complimentary portions are operatively juxtaposed.

2. The pillow of claim 1 further comprising a second lateral support portion also being relatively thick, projecting a predetermined distance transversely and upwardly from the upper surface, and positioned laterally adjacent the base portion on an opposite side to the first support portion.

3. The pillow of claim 1 further comprising engagement means provided on the lower surface which is adapted to frictionally engage the inclined surface.

4. The pillow claim 1 wherein the support portion includes a retaining means for resisting, in use, relative movement between the pillow and the user's head.

5. The pillow of claim 4 wherein the retaining means includes a formed recess for partially accommodating the head of the user.

6. The pillow of claim 5 wherein the support portion has an elongate rectangular form with a beveled longitudinal edge adjacent to the base portion and against which, in use, the user's head leans;

wherein the beveled edge reduces in size towards the ends of the support portion so as to define a concave surface.

7. The pillow of claim 1 being constructed from an expanded foam rubber or synthetic plastics material having a density/hardness ratio index number of between HR 22/40 and HR 32/80 and preferably approximately HR 30/60.

8. The pillow of claim 1 wherein the support portion is between 50 and 150 mm thick and the base portion is between 5 and 25 mm thick.

* * * * *